United States Patent [19]

Lewis

[11] 4,067,737

[45] Jan. 10, 1978

[54] PROCESS OF APPLYING PROTECTIVE COATING

[76] Inventor: Anthony Vincent Lewis, "Meres Vean", Laflouder Lane, Mullion, Cornwall, England

[21] Appl. No.: 746,746

[22] Filed: Dec. 2, 1976

[51] Int. Cl.[2] ..... B05C 11/02; G03C 11/08

[52] U.S. Cl. ..... 96/50 PL; 118/257; 427/445

[58] Field of Search ..... 118/106, 257, 100, 400, 118/407, 414, 503, 506; 427/4, 140–142, 144, 2, 145, 277, 359, 361–366, 369, 430, 428, 439, 445, 354; 354/354, 346, 347; 96/50 PL, 200; 35/26; 428/203, 204, 205

[56] References Cited

U.S. PATENT DOCUMENTS

| | | | |
|---|---|---|---|
| 287,530 | 10/1883 | Friedrichs | 118/506 |
| B 354,008 | 1/1975 | Chiklis | 96/50 PL X |
| 1,411,677 | 4/1922 | Trivelli | 428/205 |
| 1,507,856 | 9/1924 | Robertshaw | 354/346 |
| 1,946,005 | 2/1929 | Steele | 96/50 PL X |
| 2,254,429 | 9/1941 | Kreutzer | 427/359 X |
| 2,311,518 | 2/1943 | Caligari, Jr. | 427/359 |
| 2,798,021 | 7/1957 | Land | 90/50 PL X |
| 2,895,847 | 7/1959 | Mayo | 118/257 X |
| 3,147,688 | 9/1964 | Buckley et al. | 354/346 |
| 3,925,081 | 12/1975 | Chiklis | 90/50 PL X |

*Primary Examiner*—Morris Kaplan

*Attorney, Agent, or Firm*—Cushman, Darby & Cushman

[57] ABSTRACT

A clear resin protective coating is applied to a picture by spreading liquid resin over the picture surface from one edge using a spreader sheet under tension which is carried by a frame hinged parallel to one edge of the picture, so that a 'wedge' of resin is advanced over the picture surface as the frame is lowered, forming upon curing a clear protective layer.

6 Claims, 1 Drawing Figure

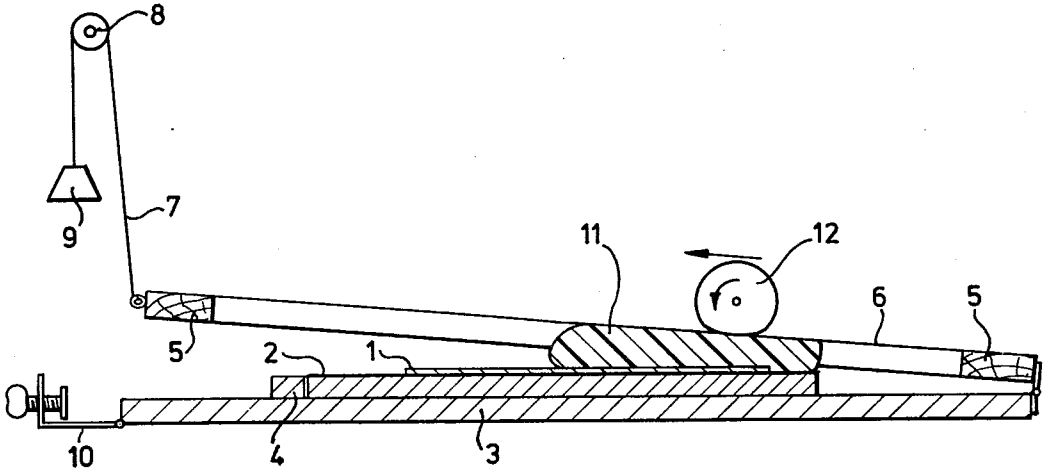
8
9
7
5
2
1
11
12
6
5
3
4
10

PROCESS OF APPLYING PROTECTIVE COATING

This invention relates to the treatment of pictures.

The object of the invention is to provide a process for the surface treatment of pictures by means of which pictures can be given a clear and durable protective coating.

The present invention accordingly provides in one aspect a process for applying a protective coating to a picture in which a clear synthetic resin in a liquid or semi-liquid state is applied to the surface of the picture adjacent one edge thereof and is spread evenly and without the formation of bubbles or occlusions over the picture surface from the said edge by pressing a flexible spreader sheet over the surface progressively from the said edge, the surface of the spreader sheet in contact with the resin being such as or so treated as not to adhere to the resin, and removing the sheet after curing of the resin, so that the latter forms a clear protective layer on the picture surface.

The spreader sheet, which may conveniently comprise clear plastics film maintained under tension, is, in a preferred embodiment of the invention, progressively pressed over the resin coating by advancing a roller over the sheet, the axis of the roller being substantially parallel to the said edge of the picture.

The resin applied to the picture may be a chemically hardening or thermosetting plastics, which sets to form a hard clear protective coating on the surface of the picture.

A picture treated in accordance with the invention is extremely durable and is easy to handle. Moreover, since the protective layer applied to the picture can be formed with a glazed or highly polished surface, it is not necessary to mount the picture in a glazed frame.

The present invention also provides, in another aspect, a process for applying a protective coating to a picture comprising a flat horizontal base on which a picture to be treated may be placed, with its picture surface uppermost, a movable frame disposed above the base and supporting a flexible spreader sheet under tension, the frame being hinged to the base at one edge for movement relative to the base about a hinge axis substantially parallel to one edge of the picture, the frame being movable between a raised position in which it permits removal of a picture from and placement of a picture on the base and a lowered position in which the spreader sheet is, when the apparatus is in use, parallel to the picture surface and spaced therefrom, so that a clear synthetic resin in liquid or semi-liquid state can be introduced between the spreader sheet and the picture surface and spread evenly over the said surface from the edge of the picture nearest the hinge axis of the movable frame, and a releasable clamp device for clamping the frame in its lowered position relative to the base, at least the lower surface of the spreader sheet being such as or so treated as not to adhere to the resin.

In a preferred method of carrying out the invention the picture to be treated, which may consist, for example, of an original painting, a drawing, map, print or photographic print, may initially be mounted on a rigid backing member, either singly or together with other pictures. The backing member may be of any convenient material, for example blockboard, chipboard, hardboard or wood, and the picture would normally be mounted on the board by a conventional glueing method. After this mounting the picture is preferably given a thin brushed coating of a clear sealant material such as a thick polyester resin to seal the picture, this resin being allowed to harden to seal the picture before the protective layer is applied.

A typical apparatus according to one embodiment of the invention is illustrated, by way of example, in the accompanying FIGURE of drawing, which is a diagrammatic longitudinal section through the apparatus during the treatment of a picture by the process of the present invention.

Referring to the drawing, a picture 1, for example a print or prints, to be treated is adhesively mounted on a rigid backing board 2 as previously described and given a clear resin sealing coating by brushing on a thick polyester resin. The board-mounted sealed picture is then placed on a flat horizontal base 3 with one edge of the board 2 abutting an upstanding stop 4 on the base 3.

A wooden rectangular frame 5 of suitable size, for example 2 × 3 ft. is hinged at one edge to one edge of the base 3 for movement about a hinge axis which is parallel to one edge of the picture 1. Before attaching the frame 5 to the base 3 a spreader sheet 6 of flexible clear plastics film, preferably "Melinex" TM not less than 100 microns thick and of suitable grade, is placed on the face of the frame 5 which is lowermost when the frame is attached to the base. The spreader sheet 6 is attached, for example by stapling, to the upper face of the frame 5, being wrapped around the edges of the frame. After attachment to the frame 5 the plastics sheet 6 is heat-treated to cause the film to contract, thereby stretching it uniformly in the frame 5, so that the film constituting the spreader sheet 6 becomes drum tight.

The end of the frame 5 remote from the hinged end is supported by a cord or wire 7 which passes over a fixed freely rotatable pulley 8 to a freely hanging counterweight 9 of such a size as to support the frame 5 in a neutral or rest position as shown in which it is raised from the base 3 so as to enable a board-mounted picture 1 to be treated to be placed on the base 3 against the stop 4.

The end of the base 3 remote from its hinge attachment to the frame 5 is provided with a suitable releasable clamp device 10 adapted to engage the adjacent end of the frame 5 when the latter is lowered fully onto the base 3. The thickness of the frame 5 is such that in the fully lowered position, the plastics sheet 6 supported by the frame 5 is parallel to the surface of the picture 1 to be coated and spaced therefrom by a predetermined distance, shown exaggerated in the drawing for clarity, which ensures the absence of vertical forces between the plastics spreader sheet 6 and the picture backing board 2 when the frame 5 is fully lowered. The absence of such vertical forces avoids any tendency towards partial or momentary separation of the sheet 6 from the picture backing board 2, which could lead to ingress of air. If desired suitable distance pieces may be interposed between the frame 5 and the base 3 to ensure the requisite spacing between the spreader sheet 6 and the surface of the picture 1.

When carrying out the process of the present invention a release agent such as a fluorinated hydrocarbon is first applied by spraying onto the lower surface of the stretched plastics film spreader sheet 6, taking care to avoid scratching of this film. With the frame 5 initially fully raised a bubble free clear synthetic resin 11 in liquid or semi-liquid form, with a hardener, is applied to the face of the picture backing board 2 across the entire width of the latter at the end thereof adjoining the hinged end of the frame 5. The frame 5 is then lowered until contact is made between the coated surface of the film 6 and the resin 11. A roller 12 of resiliently soft, flexible material mounted upon a rigid shaft is then pressed onto the plastics spreader sheet 6 adjacent the edge of the picture backing board 2 at which the resin 11 has been applied, with the axis of the roller 12 parallel to this edge. The length of the roller 12 should be at least equal to the entire width of the spreader sheet 6 and the underlying board 2.

The roller 12 is then rolled carefully over the upper surface of the spreader sheet 6 with sufficient maintained downward pressure to cause continuous flowing of the resin 11 over the board 2 and the picture 1 mounted thereon, the frame 5 being at the same time lowered progressively onto the base board 3 until the fully lowered position is reached, in which the sheet 6 is parallel to and spaced from the surface of the board 2 and a uniform bubble-free plastics layer fills the space between the sheet 6 and the board 2. In fact, the progressive advance of the roller 12, from right to left as viewed in the drawing, pushes a wave of resin, trapped beneath the sheet 6, ahead of the roller. This wave effectively pushes out the air from the space beneath the sheet 6, ensuring complete exclusion of air from the resin coating.

When the roller 12 has reached the end of its travel, at the stop 4, the counterweight 9 is disconnected and the frame 5 held in position on the base 3 by means of the clamp device 10, with the sheet 6 parallel to the surface of the board 2. The entire assembly is allowed to remain at a suitable temperature, appropriate to the resin 11, until the resin 11 has completely hardened. The clamp device 10 is then released and the frame 5 lifted to separate the plastics film spreader sheet 6 from the clear hard protective layer of resin which will have formed on the board 2 and the picture 1 mounted thereon.

Any suitable clear resin which sets to a fully hard condition may be used to form the protective layer over the picture. The resin may be entirely thermosetting, or may be of the chemically hardening type herein described requiring admixture with a hardener before application to the surface to be coated.

I claim:

1. Process for applying a protective coating to the surface of a picture comprising the steps of:

applying a clear synthetic resin in liquid state to the surface of the picture adjacent one edge thereof, spreading the liquid resin evenly and without the formation of bubbles or occlusions over the said picture surface from the said edge by pressing a flexible spreader sheet under tension over the surface progressively from the said edge, the surface of the spreader sheet which contacts the resin being such that the resin does not adhere thereto, curing the resin, and removing the sheet to leave a hard, clear protective layer of resin on the picture surface.

2. Process as defined in claim 1, in which the sheet is progressively pressed over the resin coating by advancing a roller over the sheet, the axis of the roller being substantially parallel to the said edge of the picture.

3. Process as defined in claim 1, in which the synthetic resin is admixed with a chemical hardening agent.

4. Process as defined in claim 1, in which the spreader sheet comprises a flexible clear plastics film.

5. Process as defined in claim 1, in which the picture to be coated, prior to the application of the liquid synthetic resin, is mounted upon a rigid backing member and its surface sealed by the application thereto of a coating of clear sealant material which is allowed to harden before the liquid resin is spread on the sealed surface.

6. Process as defined in claim 1, in which a release agent is applied to the surface of the spreader sheet which comes into contact with the synthetic resin.

* * * * *